United States Patent [19]

Khuri-Yakub et al.

[11] Patent Number: 5,028,937

[45] Date of Patent: Jul. 2, 1991

[54] PERFORATED MEMBRANES FOR LIQUID CONTRONLIN ACOUSTIC INK PRINTING

[75] Inventors: Butrus T. Khuri-Yakub, Palo Alto; Scott A. Elrod, Menlo Park; Calvin F. Quate, Stanford; Eric G. Rawson, Saratoga; Babur B. Hadimioglu, Palo Alto, all of Calif.

[73] Assignee: Xerox Corporation, Stamford, Conn.

[21] Appl. No.: 358,752

[22] Filed: May 30, 1989

[51] Int. Cl.[5] ..... B41J 2/045; B41J 2/175

[52] U.S. Cl. ..... 346/140 R

[58] Field of Search ..... 346/140

[56] References Cited

U.S. PATENT DOCUMENTS

| | | | |
|---|---|---|---|
| 3,211,088 | 10/1965 | Naiman | 346/140 X |
| 4,308,547 | 12/1981 | Lovelady | 346/140 |
| 4,719,476 | 1/1988 | Elrod | 346/140 |
| 4,751,529 | 6/1988 | Elrod | 346/140 |
| 4,801,953 | 1/1989 | Quate | 346/140 |

FOREIGN PATENT DOCUMENTS

| | | |
|---|---|---|
| 97859 | 5/1985 | Japan . |
| 170350 | 7/1987 | Japan . |

*Primary Examiner*—Joseph W. Hartary

[57] ABSTRACT

In accordance with the present invention, an acoustic ink printer comprises a pool of liquid ink having a free surface in intimate contact with the inner face of a perforated membrane. The printer addresses all pixel positions within its image field via substantially uniform, relatively large diameter apertures which extend through the membrane on centers that are aligned with respective ones of the pixel positions. In operation, one or more focused acoustic beams selectively eject individual droplets of ink from the ink menisci that extend across the apertures. Accordingly, the membrane is positioned and the bias pressure that is applied to the ink is selected so that the menisci essentially remain within the focal plane of such beam or beams.

10 Claims, 2 Drawing Sheets

PERFORATED MEMBRANES FOR LIQUID CONTRONLIN ACOUSTIC INK PRINTING

FIELD OF THE INVENTION

This invention relates to acoustic ink printing and, more particularly, to improved methods and means for maintaining the free ink surfaces of such printers at essentially constant levels.

BACKGROUND OF THE INVENTION

Acoustic ink printing has been identified as a promising direct marking technology. See, for example, Elrod et al. U.S. Pat. No. 4,751,530 on "Acoustic Lens Array for Ink Printing", Elrod et al. U.S. Pat. No. 4,751,529 on "Microlenses for Acoustic Printing", and Elrod et al. U.S. Pat. No. 4,751,534. on "Planarized Printheads for Acoustic Printing". The technology is still in its infancy, but it may become an important alternative to ink jet printing because it avoids the nozzles and small ejection orifices that have caused many of the reliability and pixel placement accuracy problems which conventional drop on demand and continuous stream ink jet printers have experienced.

This invention builds upon prior acoustic ink printing proposals relating to the use of focused acoustic radiation for ejecting individual droplets of ink on demand from a free ink surface at a sufficient velocity to deposit them in an image configuration on a nearby recording medium. Droplet ejectors embodying acoustic focusing lenses, such as described in the aforementioned Elrod et al patents, and piezoelectric shell transducers, such as described in Lovelady et al U.S. Pat. No. 4,308,547, which issued Dec. 29, 1981 on a "Liquid Drop Emitter," have been proposed for carrying out such printing. Moreover, techniques have been developed for modulating the radiation pressure which such beams exert against the free ink surface, thereby permitting the radiation pressure of any selected beam to make brief, controlled excursions to a sufficiently high pressure level for ejecting individual droplets of ink from the free ink surface (i.e., a pressure level sufficient to overcome the restraining force of surface tension) on demand.

As is known, acoustic ink printers of the foregoing type are sensitive to variations in their free ink surface levels. Even if the half wave resonances of their resonant acoustic cavities are effectively suppressed as taught by an Elrod et al U.S. patent application, which was filed Dec. 21, 1988 under Ser. No. 07/287791 for "Acoustic Ink Printers Having Reduced Focusing Sensitivity", the size and the velocity of the ink droplets they eject are difficult to control, unless their free ink surfaces remain within the effective depth of focus of their droplet ejector or ejectors. Preferably, therefore, the free ink surface level of such a printer is closely controlled. For instance, the depth of focus of state of the art acoustic lens type droplet ejectors typically is comparable to the wavelength of the acoustic radiation in the ink.

To that end, prior acoustic ink printers have included provision for maintaining their free ink surfaces at more or less constant levels. For example, a copending and commonly assigned Elrod et al. U.S. patent application, which was filed on Dec. 19, 1986 on "Variable Spot Size Acoustic Printing" suggests using a closed loop servo system for increasing and decreasing the level of the free ink surface under the control of an error signal which is produced by comparing the output voltage levels from the upper and lower halves of a split photodetector. The magnitude and sense of that error signal are correlated with the free ink surface level because a laser beam is reflected off the free ink surface to symmetrically or asymmetrically illuminate the opposed halves of the photodetector depending upon whether the free ink surface is at a predetermined level or not. As will be appreciated, that sometimes is a workable solution to the problem, but it is costly to implement and requires that provision be made for maintaining the laser and the split photodetector in precise optical alignment. Moreover, it is not well suited for use with larger droplet ejector arrays because the surface tension of the ink tends to cause the level of the free ink surface to vary materially when the free surface spans a large area.

Ink transport mechanisms also have been proposed for refreshing the ink supplies of such printers, including transports having apertures for entraining the ink while it is being transported from a remote inking station to a position in acoustic alignment with the printhead. See Quate U.S. Pat. No. 4,801,953, which issued Jan. 31, 1989 on "Perforated Ink Transports for Acoustic Ink Printing". Also see Quate U.S. Pat. No. 4,797,693, which issued Jan. 10, 1989 on "Polychromatic Acoustic Ink Printing". However, the free ink surface level control that is provided by these transports is dependent upon the uniformity of the remote inking process and upon the dynamic uniformity of the ink transport process.

SUMMARY OF THE INVENTION

In accordance with the present invention, an acoustic ink printer comprises a pool of liquid ink having a free surface in intimate contact with the inner face of a perforated membrane. The printer addresses all pixel positions on its recording medium via substantially uniform, relatively large diameter apertures which extend through the membrane on centers that are aligned with respective ones of the pixel positions. Capillary attraction causes ink menisci to extend across each of the apertures at essentially the same level. Furthermore, during operation, an essentially constant bias pressure is applied to the ink for maintaining the menisci at a predetermined level.

To carry out printing, acoustic beams are focused on the menisci within the apertures for selectively ejecting individual droplets of ink from them on demand, but the focused waist diameters of these beams are significantly smaller than the diameter of the apertures, so the apertures have no material affect on the size of the droplets that are ejected. The bias pressure that is applied to the ink may be increased or decreased while the printer is being readied for operation to increase or decrease, respectively, the level at which the menisci are held, thereby permitting them to be more precisely positioned in the focal plane of the acoustic beams.

The apertures may be formed while the membrane is being manufactured or, in some situations, they might be formed in situ, such as by thermally or acoustically forming them in a plastic membrane. If desired, the outer face of the membrane may be configured to have narrow, annular mesas extending radially outwardly from each of the apertures for deflecting ink, dust and other debris away from the apertures, thereby reducing the perturbation of the menisci by such debris.

BRIEF DESCRIPTION OF THE DRAWINGS

Additional features and advantages of this invention will become apparent when the following detailed description is read in conjunction with the attached drawings, in which.

DETAILED DESCRIPTION OF THE ILLUSTRATED EMBODIMENTS

While the invention is described in some detail hereinbelow with specific reference to certain illustrated embodiments, it is to be understood that there is no intent to limit it to those embodiments. On the contrary, the aim is to cover all modifications, alternatives and equivalents falling within the spirit and scope of the invention as defined by the appended claims.

Figure 1:
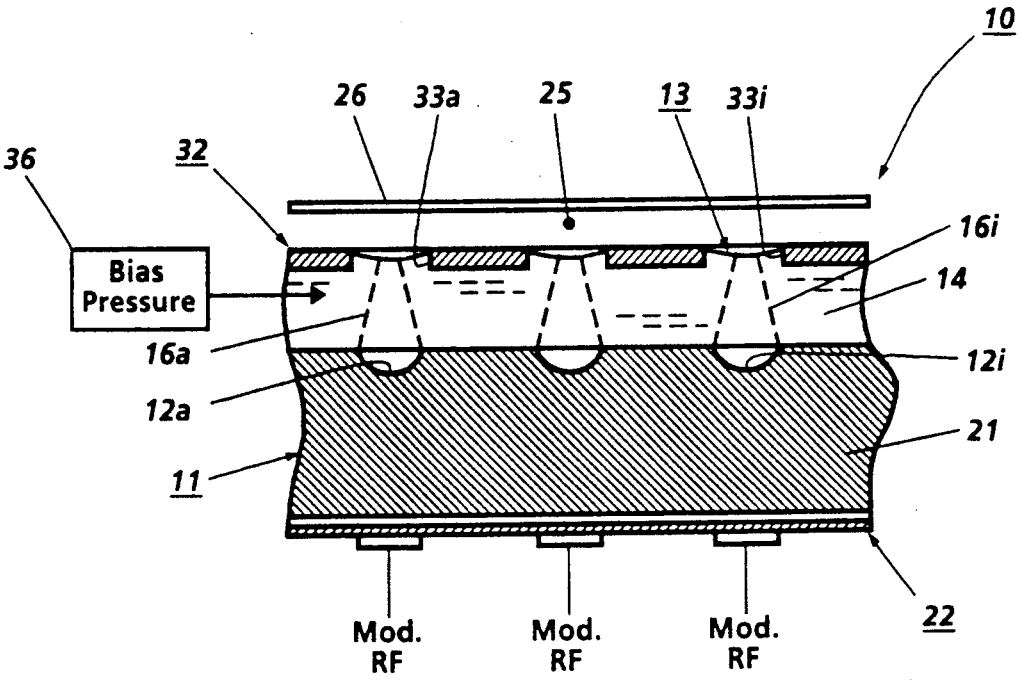
FIG. 1 is a fragmentary, transverse sectional view of an acoustic ink printer embodying the present invention.

Turning now to the drawings, and at this point especially to FIG. 1, it will be seen that there is an acoustic ink printer 10 (shown only in relevant part) having a printhead 11 comprising an array of acoustic focusing lenses 12*a*–12*i* for radiating the free surface 13 of a pool of liquid ink 14 with focused acoustic beams 16*a*–16*i*, respectively. As shown, the lenses 12*a*–12*i* are acoustically coupled directly to the ink 14, but it will be understood that they could be coupled to it via one or more intermediate, liquid or solid, acoustic coupling media (not shown).

In keeping with prior proposals, the lenses 12*a*–12*i* are defined by more or less identical, small spherical depressions or indentations that are formed on spaced apart centers in a face (e.g., the upper face) of a substrate 21 which is composed of a material having a much higher acoustic velocity than the ink 14. For example, when ordinary water based or oil based inks are employed, this criterion can be satisfied by fabricating the lens substrate 21 from materials such as silicon, silicon carbide, silicon nitride, alumina, sapphire, fused quartz and certain glasses.

During operation, the lenses 12*a*–12*i* are independently acoustically illuminated from the rear by respective acoustic waves which are coupled into the substrate 21 by a suitable acoustic generator, such as an rf excited, spatially addressable, piezoelectric transducer 22. As will be appreciated, the lenses 12*a*–12*i* may be axially aligned on equidistant centers to provide a linear array of droplet ejectors, or they may be arranged in a plurality of rows on staggered centers to provide a staggered droplet ejector array. Indeed, it will become evident that the present invention can be used to advantage with acoustic printheads having one or several droplet ejectors in various geometric configurations.

Figure 2:
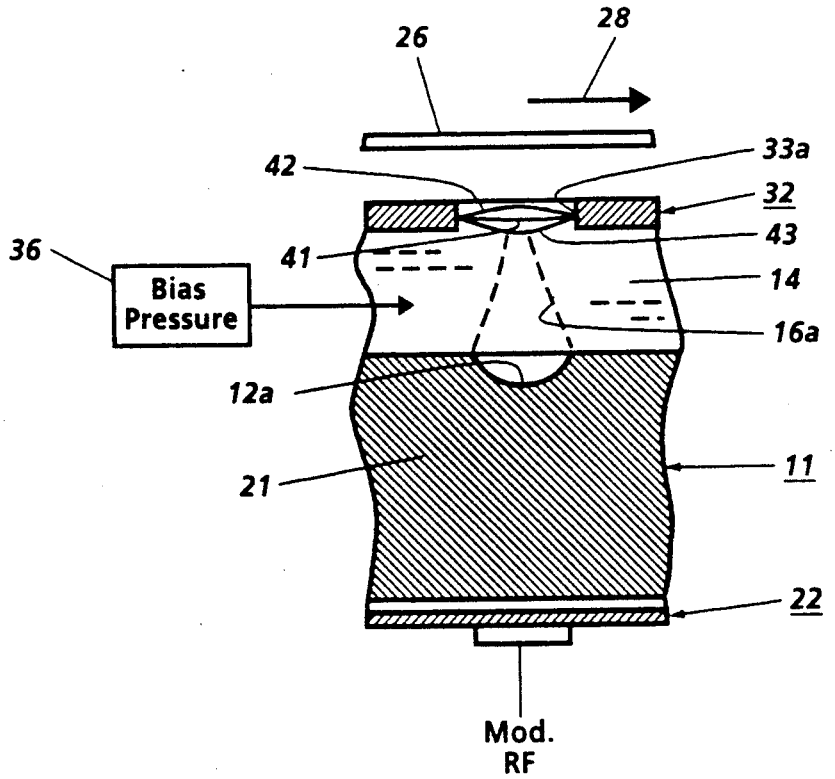
FIG. 2 is an enlarged and fragmentary, sagittal sectional view of the printer shown in FIG. 1.

As previously pointed out, printing is performed by modulating the radiation pressure which each of the acoustic beams 16*a*–16*i* exerts against the free ink surface 13, whereby individual droplets of ink 25 are ejected from the free surface 13 on demand at a sufficient velocity to cause them to deposit in an image configuration on a nearby recording medium 26. For example, as schematically illustrated, when a spatially addressable piezoelectric transducer 22 is employed for acoustically illuminating the lenses 12*a*–12*i*, its rf excitation may be pulse width modulated on a lens-by-lens basis to modulate the radiation pressures of the beams 16*a*–16*i*. Typically, the printhead 11 is configured and/or is translated transversely with respect to the recording medium 26 to address all pixel positions across the full width of the image field. Consequently, the recording medium 26 generally is longitudinally advanced with respect to the printhead 11, as indicated in FIG. 2 by the arrow 28.

In accordance with the present invention, the free ink surface 13 is maintained in intimate contact with the inner face of a perforated, planar membrane 32, which is supported (by means not shown) in the focal plane of the lenses 12*a*–12*i* in parallel alignment with the lens substrate 21. A plurality of substantially uniform perforations or apertures 33*a*–33*i* extend through the membrane 32 on centers that are aligned with one after another of the pixel positions along the transverse dimension of an image field, thereby enabling the printhead 11 to address all of the pixel positions across the full page width of the image field. The droplets of ink 25 are ejected from the free ink surface 13 more or less centrally of one or more of the apertures 33*a*–33*i*, but the aperture diameters are substantially larger than the waist diameters of the focused acoustic beams 16*a*–16*i*, thereby precluding them from having any significant affect on the size of the droplets 25.

As a general rule, there is substantially the same capillary attraction between the ink 14 and the sidewalls of each of the apertures 33*a*–33*i*, so the intimate contact of the ink 14 with the inner face of the membrane 32, together with the uniformity of the apertures 33*a*–33*i*, causes ink menisci to extend across each of the apertures 33*a*–33*i* at essentially the same level. Furthermore, during operation, a substantially constant bias pressure is applied to the ink 14, such as by an external pressure controller 36, thereby maintaining all of these menisci at an essentially constant level. As shown in FIG. 2, this bias pressure may be increased or decreased while the printer 10 is being readied for operation to increase or decrease the level of the ink menisci within the apertures 33*a*–33*i*, as indicated generally at 41–43, thereby permitting the menisci (i.e., the portions of the free ink surface 13 from which the ink droplets 25 are ejected) to be more precisely positioned in the focal plane of the lenses 12*a*–12*i*.

Figure 3:
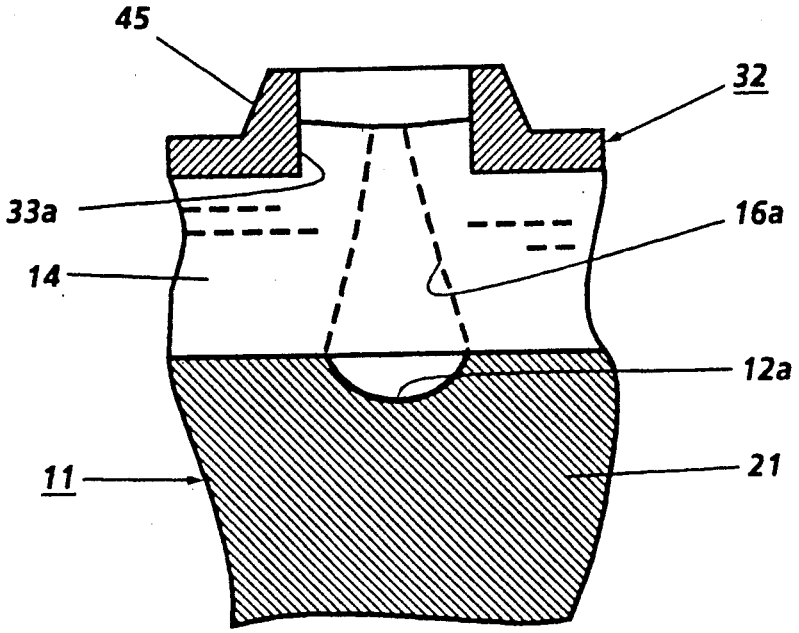
FIG. 3 is a fragmentary, sagittal sectional view of a acoustic ink printer comprising a modified embodiment of the present invention.
Figure 4:
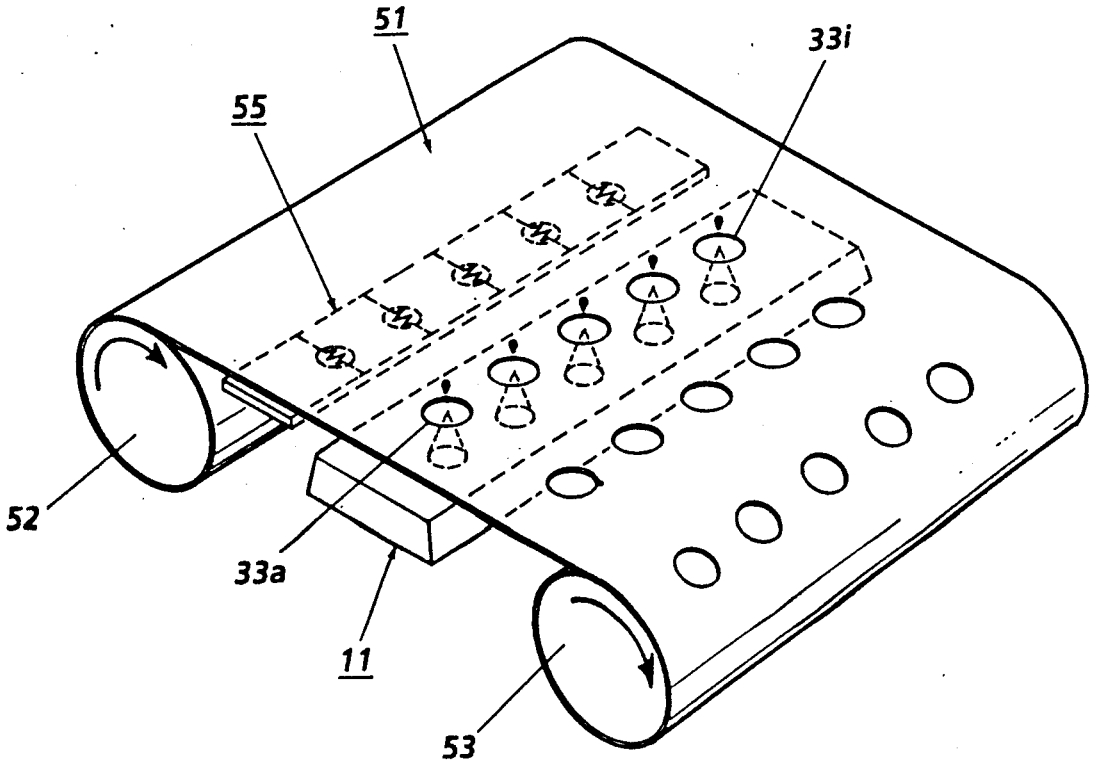
FIG. 4 is a schematic view of another embodiment of the invention.

Turning to FIG. 3, in keeping with one of the more detailed features of this invention, the spatial stability of the ink menisci within the apertures 33*a*–33*i* may be improved by configuring the outer face of the membrane 32 so that it has elevated, narrow mesas 45 extending outwardly from the apertures 33*a*–33*i*. Ink, dust and other debris may tend to fall on the outer face of the membrane 32 during operation, so the sides of these mesa-like structures 45 are sloped downwardly for deflecting much of debris away from the apertures 33*a*–33*i*, thereby reducing the accumulation of debris in the immediate proximity of the apertures 33*a*–33*i*. For example, the mesas 45 may be annular for providing dedicated anti-debris protection for each of the apertures 33*a*–33*i*, Typically, the membrane 32 is metallic, such as brass or beryllium copper shimstock, and the apertures 33*a*–33*i* are precisely machined in it, such as by chemical etching. Plastic membranes are, however, a conceivable alternative. As will be understood, a plastic membrane 51 could be perforated while it is being fabricated. Alternatively, it might be perforated in situ, either by heat or by acoustic energy. With that in mind, as schematically shown in FIG. 4, there is a plastic membrane 51 which is stripped off a feed roll 52 on one side of the printhead 11 and collected by a take-up roll 54 on the opposite side of the printhead 11. Consequently, whenever one section of the membrane 51 has served its useful life, as determined either by subjectively examining it or in accordance with a predetermined replacement schedule, a fresh section of the membrane 51 can be advanced into position to replace it. As will be appreciated, one of the advantages of advancing the membrane 51 across the free ink surface 13 (FIG. 1) from time-to-time is that much of the dust and other debris that may have accumulated on the menisci within the apertures 33*a*–33*i* is dragged away from the printhead 11 as the membrane 51 is moved.

If desired, an array of heating elements 55 may be employed for perforating the fresh section of the membrane 51 as it is being moved into alignment with the printhead 11. Or, the printhead 11 may be employed to acoustically perforate the fresh section of the membrane 51 after it has been moved into position, such as by driving the droplet ejectors at a subharmonic of the rf frequency that is employed for printing.

CONCLUSION

In view of the foregoing it will be appreciated that the present invention provides reliable and relatively inexpensive methods and means for maintaining the free ink surface of an acoustic ink printer essentially at an optimum level. Pre-perforated metallic membranes currently are favored for carrying out the present invention, but membranes composed of other materials, such as plastics, as well as membranes which are perforated in situ, are possible alternatives.

What is claimed:

1. In combination with an acoustic ink printer having a pool of liquid ink with a free surface, and a printhead including at least one droplet ejector for radiating the free surface of said ink with focused acoustic radiation to eject individual droplets of ink therefrom on demand, said radiation being brought to focus with a finite waist diameter in a focal plane; the improvement comprising a membrane having an inner face in intimate contact with the free surface of said ink; said membrane being configured to have a plurality of apertures of substantially equal size which pass through it on centers that are aligned with respective pixel positions in an image field, whereby the free surface of said ink forms essentially coplanar menisci across said apertures; said apertures being substantially larger than the waist diameter of said acoustic radiation, whereby droplets of various sizes can be ejected without having their sizes materially affected by said apertures; and means for maintaing said menisci substantially in said focal plane during operation.

2. The improvement of claim 1 wherein said means for maintaining said menisci substantially in said focal plane includes means for applying a substantially constant bias pressure to said ink during operation.

3. The improvement of claim 2 wherein said membrane is metallic.

4. The improvement of claim 2 wherein said membrane is elongated, said printer includes a feed roll from which fresh membrane is stripped on one side of said printhead, and a pickup roll by which used membrane is collected on the opposite side of said printhead.

5. The improvement of claim 4 wherein said membrane is plastic.

6. The improvement of any of claims 1–5 wherein said membrane has an outer face configured to form elevated mesa means proximate said apertures, said mesa means sloping downwardly away from said apertures for deflecting debris away therefrom.

7. The improvement of claim 5 wherein said printer further includes means for forming said apertures in said membrane in situ.

8. The improvement of claim 2 wherein said membrane is elongated, said printer includes means for advancing said membrane across said printhead, whereby fresh sections of said membrane are moved into alignment with said printhead for replacing used sections.

9. The improvement of any of claim 8 wherein said membrane has an outer face configured to form elevated mesa means proximate said apertures, and said mesa means slope downwardly away from said apertures for deflecting debris away therefrom.

10. The improvement of claim 8 wherein said printer further includes means for forming said apertures in said membrane in situ.

* * * * *

UNITED STATES PATENT AND TRADEMARK OFFICE

CERTIFICATE OF CORRECTION

PATENT NO. : 5,028,937

DATED : July 2, 1991

INVENTOR(S) : Butrus T. Khuri-Yakub et al.

It is certified that error appears in the above--identified patent and that said Letters Patent is hereby corrected as shown below:

On the title page of the patent, in the title, Field 54, change "CONTRONLIN" to --CONTROL IN--, so that the title now reads: PERFORATED MEMBRANES FOR LIQUID CONTROL IN ACOUSTIC INK PRINTING.

Column 1, line 3, change "CONTRONLIN" to --CONTROL IN--.

Signed and Sealed this

Third Day of November, 1992

*Attest:*

DOUGLAS B. COMER

*Attesting Officer*

*Acting Commissioner of Patents and Trademarks*